United States Patent [19]

Stahlecker

[11] Patent Number: 5,042,112

[45] Date of Patent: Aug. 27, 1991

[54] DRAFTING UNIT FOR A SPINNING MACHINE

[75] Inventor: Hans Stahlecker, Süssen, Fed. Rep. of Germany

[73] Assignee: Fritz Stahlecker, Fed. Rep. of Germany; a part interest

[21] Appl. No.: 496,934

[22] Filed: Mar. 21, 1990

[30] Foreign Application Priority Data

Mar. 22, 1989 [DE] Fed. Rep. of Germany ..... 3909421

[51] Int. Cl.[5] ..... D01H 5/86

[52] U.S. Cl. ..... 19/252; 19/249; 19/253

[58] Field of Search ..... 19/249, 252–255

[56] References Cited

U.S. PATENT DOCUMENTS

| | | | |
|---|---|---|---|
| 2,471,057 | 5/1949 | Bird | 19/251 |
| 2,932,067 | 4/1960 | Arakawa | 19/255 |
| 3,056,174 | 10/1962 | MacDonald | 19/255 |
| 3,126,585 | 3/1964 | Tabor et al. | 19/251 |
| 3,129,467 | 4/1964 | Swanson | 19/255 |
| 3,389,437 | 6/1968 | Andreani | 19/252 |

FOREIGN PATENT DOCUMENTS

| | | | |
|---|---|---|---|
| 1278904 | 5/1969 | Fed. Rep. of Germany . | |
| 2749727 | 5/1979 | Fed. Rep. of Germany | 19/254 |
| 3716864 | 12/1988 | Fed. Rep. of Germany | 19/253 |
| 496117 | 10/1970 | Switzerland . | |

*Primary Examiner*—Werner H. Schroeder
*Assistant Examiner*—John J. Calvert
*Attorney, Agent, or Firm*—Evenson, Wands, Edwards, Lehanan & McKeown

[57] ABSTRACT

In a drafting unit for a spinning machine having an apron guide between a pair of rollers, it is provided that the bottom apron wound around a bottom roller is tensioned by means of a movable bottom apron bridge.

18 Claims, 2 Drawing Sheets

DRAFTING UNIT FOR A SPINNING MACHINE

BACKGROUND AND SUMMARY OF THE INVENTION

The invention relates to a drafting unit for a spinning machine having several pairs of rollers which each contain a bottom roller and a pressure roller, and having an apron guide arranged between two pairs of rollers. An elastically tensioned bottom apron of this apron guide moves around a bottom roller and over a bottom apron bridge, the guiding surface of which is situated essentially in a common plane with the nip lines of the two pairs of rollers.

It is customary to mount bottom apron bridges in a stationary manner, particularly at roller stands receiving the bottom rollers. The required apron tensioning is generated in that a tensioning element is applied to the reversing end of the bottom apron. In a first known construction (Swiss Patent No. CH-PS 496 117), a tensioning roller is provided for the tensioning of the bottom apron, this tensioning roller being held on a pivoted spring-loaded holding device. In another construction (German Published Examined Application No. DE-AS 12 78 904), it is provided that a leaf-spring-type tensioning member is arranged at the holding device of the bottom apron bridge, this tensioning member being equipped with a spring arm which deflects and tensions the reversing end of the bottom apron.

An object of the invention is to construct a drafting unit of the initially mentioned type such that an improved tensioning and guiding of the bottom apron is obtained.

This object is achieved in that the bottom apron bridge is movably held at least approximately in the direction of its guiding surface and by means of a spring force is loaded in the direction away from the bottom roller around which the bottom apron is wound.

By means of this construction, it is achieved that the bottom apron is tensioned directly by means of the bottom apron bridge without the necessity of an additional tensioning element which additionally deflects the bottom apron. In particular, it is also ensured that the fiber-carrying end of the bottom apron is tensioned directly, i.e., by means of a force acting in its longitudinal direction so that the danger is reduced that folds, warpings, or the like are formed. In addition, it is possible to use a relatively short bottom apron. In addition, it is also possible to provide a relatively acute guiding at the end of the bottom apron bridge which faces the next pair of rollers. As a result, it is possible to continue to guide the bottom apron into the wedge-shaped gap so that the processed fiber material is guided longer.

In a further development of the invention, it is provided that movement of the bottom apron bridge in the direction of the spring force is limited by means of stop devices. As a result, the spring force tensioning the bottom apron can be precisely dimensioned by a limiting of movement and can be limited to a fixed value. The risk that the bottom apron is loaded excessively and therefore overstretched is eliminated.

In a further development of the invention, it is provided that the bottom apron bridge is mounted at a holder which can be swivelled around an axis which is parallel with respect to the bottom rollers and is loaded by means of a tension spring. The distance of the axis of the holder from the bottom apron bridge may be selected to be sufficiently large so that, in the required area, there is an approximately linear movement of the bottom apron bridge.

In a further development of the invention, it is provided that the bottom apron bridge, in the direction of its guiding surface, is form-lockingly inserted into the holder. As a result, the bottom apron bridge is securely fixed, on the one hand, while, on the other hand, it can still be detached and exchanged. In a constructively advantageous embodiment, it is provided that the holder is equipped with a U-shaped frame, in which the reversing end of the bottom apron moves and the legs of which are connected by means of the bottom apron bridge. In this embodiment, the legs of the U-shaped frame may at the same time be used as a lateral guide for the bottom apron.

In a further development of the invention, it is provided that the holder is equipped with a stop assigned to the bottom roller which follows. This stop will then define the exact position of the bottom apron bridge with respect to the nip line of the following pair of rollers. In this case, it is advantageous for the stop to be constructed as a component which is detachably and exchangeably arranged at the holder. As a result, it becomes possible, as necessary, to vary the position of the bottom apron and of the bottom apron bridge with respect to the nip line of the following pair of rollers by exchanging the holder for a holder with different dimensions and to adapt this position to the fiber material.

In a further development of the invention, a common holder is provided for the bottom apron bridge of two adjacent drafting units.

Other objects, advantages and novel features of the present invention will become apparent from the following detailed description of the invention when considered in conjunction with the accompanying drawings.

DETAILED DESCRIPTION OF THE DRAWINGS

Figure 1:
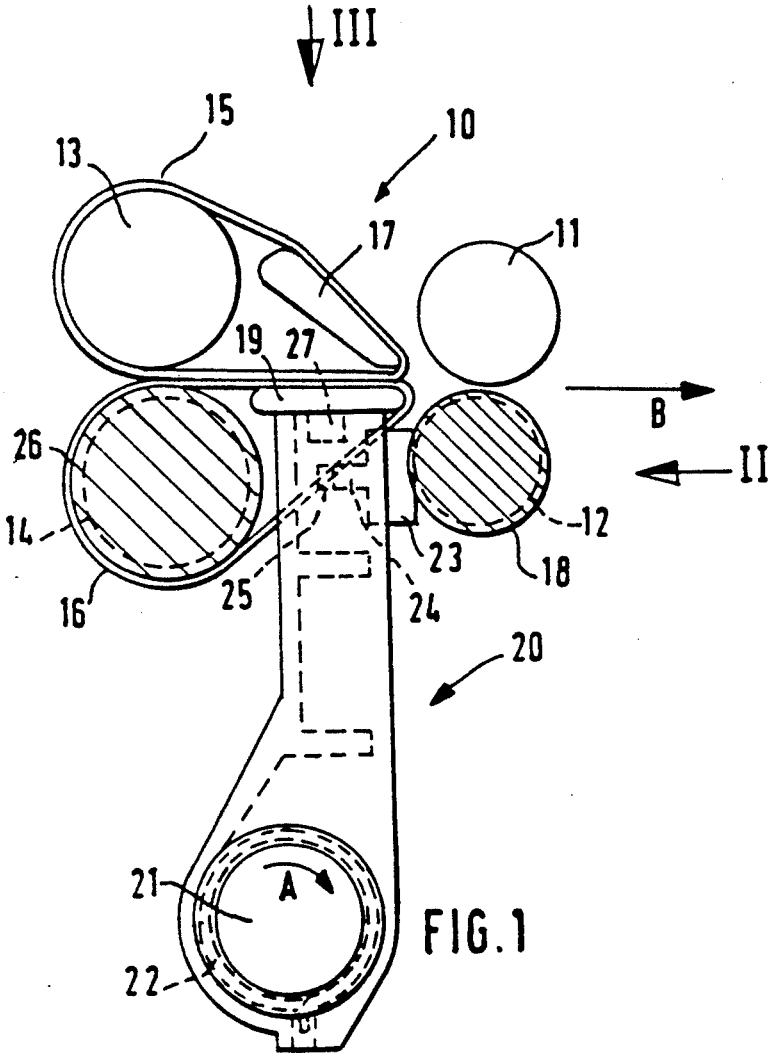
FIG. 1 is a schematic lateral view of a drafting unit constructed according to the invention in the area of a drafting zone equipped with an apron guide.

FIG. 1 shows a drafting unit 10 in the area of the last drafting zone in front of a pair of delivery rollers 11, 12. Against the moving direction (B) of a sliver to be drafted, the drafting zone is delimited by another pair of rollers 13, 14. The two roller pairs each comprise a bottom roller 12, 14 and a pressure roller 11, 13. The pressure rollers 11, 13 are held by a loading arm which is not shown and are equipped with elastic loading elements by means of which, in the operative position of the loading arm, they are pressed against the pertaining bottom rollers 12, 14. The loading arm, together with the pressure rollers 11, 13, can be swivelled away for the opening of the drafting unit 10. The shown drafting zone is preceded by other drafting zones and condensing zones for which additional roller pairs are provided which are not shown.

In the shown embodiment, the bottom rollers 12, 14 are constructed as cylinders extending through in the longitudinal direction of the machine, disposed in roller stands which are not shown, and driven at the machine end. The bottom roller 12 of the pair of delivery rollers, in the area of each drafting unit, has corrugated areas 18 with a slightly larger diameter. Bottom roller 14, around which a bottom apron 16 is wound which will be explained later, in a similar manner, has areas 26 with a slightly larger diameter which have a diagonal knurling. Deviating from the shown embodiment, it is within the scope of the invention to construct the bottom rollers 12, 14 as short, independently driven shaft ends which each extend only along the area of one drafting unit 10, 10' (FIG. 3) or along two adjacent drafting units.

In the drafting zone in front of the pair of delivery rollers 11, 12, an apron guide is provided which contains a top apron 15 and a bottom apron 16. The top apron 15 is placed around the pressure roller 13 and is guided by means of an apron cage 17 which is only outlined and which may be constructed in a conventional manner. The bottom apron 16 is wound around the knurled area 26 of the bottom roller 14 and is guided by means of a bottom apron bridge 19. The bottom apron bridge 19 has a guiding surface which is disposed approximately in the plane which is determined by the nip lines of the two pairs of rollers 11, 12, 13, 14.

The bottom apron bridge 19 is mounted at a holder 20 which can be pivoted around a shaft 21 arranged in parallel to the bottom rollers 12, 14 and at a distance from them. In the area of its shaft 21, the holder 20, by means of a wound tension spring 22, is loaded in swivel direction of arrow (A). The force of the tension spring 22 is transmitted to the bottom apron 19 which, as a result, is loaded by means of a spring tension in the direction toward the pair of delivery rollers 11, 12 and thus tensions the bottom apron 16. The holder 20 is supported in the direction of the force of the tension spring 22 by means of a stop 23 against the bottom roller 12 of the pair of delivery rollers 11, 22, the stop 23 being inserted into a recess 25 of the holder 20 by means of a web 24. The stop 23 therefore determines the distance of the bottom apron bridge 19 to the nip line determined by the pair of delivery rollers 11, 12. At the same time, the stop 23, by way of the holder 20 and thus of the bottom apron bridge 19, limits the tension force exercised on the bottom apron 16. The bottom apron 16 is guided at a relatively acute angle around the deflecting edge of the bottom apron bridge 19 facing the pair of delivery rollers 11, 12 back in a straight line to the bottom roller 14 so that the bottom apron 16 has a relatively short length. The deflecting edge of the bottom apron bridge 19 facing the pair of delivery rollers 11, 12 may therefore by guided relatively closely into the wedge-shaped gap formed by the pair of delivery rollers 11, 12; i.e., clearly farther than shown in FIG. 1. As a result, the unguided length of the processed fiber material may be reduced. In addition, the pressure roller 11 and the bottom roller 12 of the pair of delivery rollers have reduced diameters with respect to the pressure roller 13 and the bottom roller 14 of the preceding pair of rollers so that the bottom apron guide can be guided even closer to the nip line of the pair 11, 12 of delivery rollers than when diameters of the same size are used.

The bottom apron bridge 19 is inserted by means of pins 27 into recesses 28 of the holder 20 which extend approximately transversely to the guiding surface of the bottom apron bridge 19. As a result, the bottom apron bridge 19 is form-lockingly held in the holder 20 in the direction of its guiding surface. However, it may easily be demounted from the holder 20 in the vertical direction with respect to the guiding surface. As a result, it becomes possible to simply exchange the bottom apron bridge 19 for another one, for example, also for one with a different shape and/or different dimensions. Likewise, the exchange of the bottom apron 16 is relatively easy to carry out. When the bottom roller 14 is constructed as a continuous cylinder, it is useful to provide a replacement bottom apron in the vicinity of the respective drafting unit 10 which is already wound around the bottom roller 14. However, an exchange becomes particularly simple if the bottom roller 14 is constructed as a short shaft end which is overmounted and which extends only along one or two adjacent drafting units 10, 10'.

The holder 20 is produced as a molded plastic part, such as an injection-molded plastic part. The bottom apron bridge 19 and the stop 23 are also manufactured as molded plastic parts.

Figure 2:
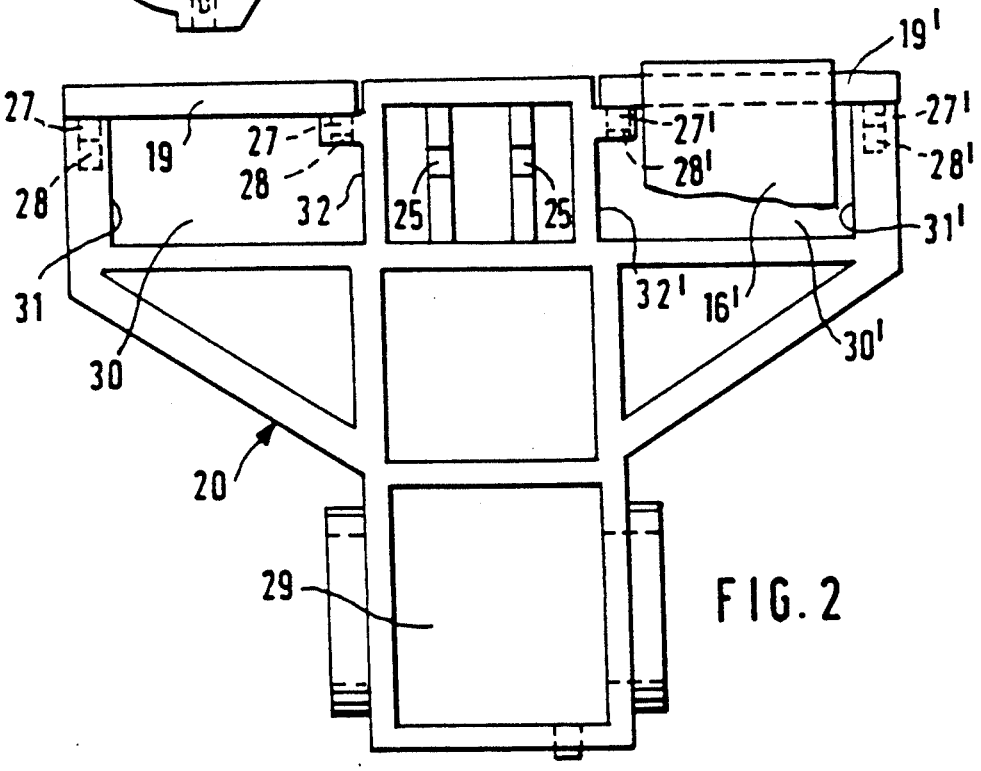
FIG. 2 is a view of the bottom apron holding device, taken in the direction of arrow II of FIG. 1.
Figure 3:
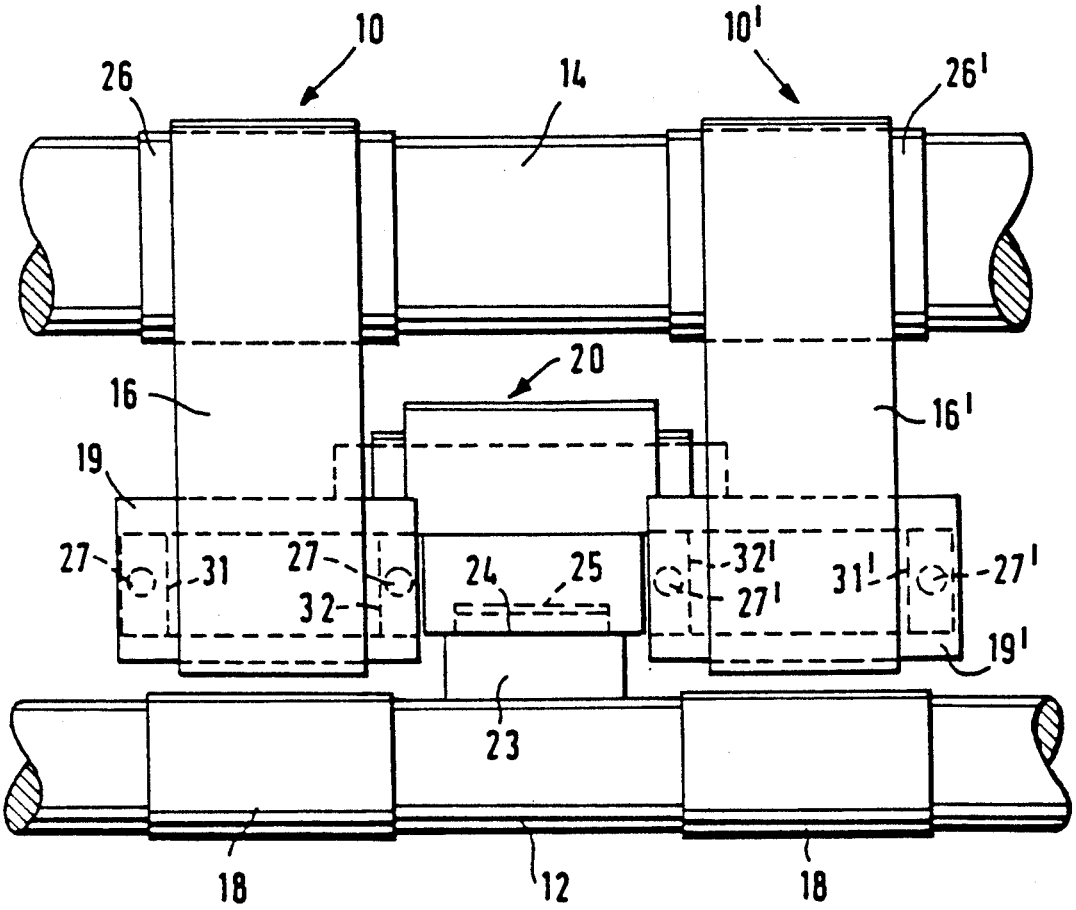
FIG. 3 is a view of the drafting unit of FIG. 1, taken in the direction of Arrow III of FIG. 1 in which, for reasons of illustration, the pressure rollers and one top apron were left out and the spacing of the bottom rollers is shown in an enlarged manner.

As shown in FIGS. 2 and 3, a common holder 20 is provided for the bottom apron bridge 19, 19' for two adjacent drafting units 10, 10'. The holder 20 is T-shaped and, at the end of the T-web, is equipped with a bearing receiving device 29 by means of which it is arranged on the shaft 21. The holder 20 consists essentially of a base plate at which reinforcing webs are mounted. In the area of the bottom aprons 16, 16', the holder 20 forms U-shaped frames 30, 30' in which the respective reversing end of the bottom apron 16, 16' is guided. The two legs 31, 32; 31', 32' are connected with one another by way of the bottom apron bridge 19, 19' so that a closed frame is formed in this area. In the area between the frames 30, 30', webs project away from the rear wall of the holder 20, in which the recesses 25 are arranged for receiving the web 24 of the stop 23.

As shown particularly in FIG. 2, the holder 20 is constructed mirror-symmetrically with respect to a plane situated between the two drafting units 10, 10'. The bottom apron bridges 19, 19' of the two adjacent drafting units 10, 10' are identically constructed components.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A drafting unit for a spinning machine or the like, comprising:

a plurality of pairs of respective top and bottom rollers, and an apron guide arranged between two pairs of rollers, said apron guide including:

a bottom apron movably supported at a bottom roller of a first pair of the rollers with respect to a travel direction of sliver being drafted by the drafting unit, a bottom apron bridge disposable to support the bottom apron and including a guiding surface extending substantially in a common plane with nip lines of the first pair of rollers and a following pair of rollers, and spring force applying means for applying spring force tending to move the bottom apron bridge in the guiding surface travel direction of the sliver away from the bottom roller of said first pair of rollers, to thereby tension the bottom apron which extends around the bottom roller of said first pair of rollers.

2. A drafting unit according to claim 1, wherein the movement of the bottom apron bridge is limited in the direction of the spring force by means of stop device means.

3. A drafting unit according to claim 1, wherein the bottom apron bridge is mounted on a holder which can be pivoted around a shaft which is parallel with respect to the bottom rollers and is loaded by means of a tension spring.

4. A drafting unit according to claim 2, wherein the bottom apron bridge is mounted on a holder which can be pivoted around a shaft which is parallel with respect to the bottom rollers and is loaded by means of a tension spring.

5. A drafting unit according to claim 1, wherein the bottom apron guide is mounted on a holder, and wherein the bottom apron bridge is form-lockingly inserted into the holder in the sliver travel direction.

6. A drafting unit according to claim 2, wherein the bottom apron guide is mounted on a holder, and wherein the bottom apron bridge is form-lockingly inserted into the holder in the sliver travel direction.

7. A drafting unit according to claim 3, wherein the bottom apron bridge is form-lockingly inserted into the holder in the sliver travel direction.

8. A drafting unit according to claim 1, wherein the bottom apron guide is mounted on a holder, and wherein the holder is equipped with a U-shaped frame in which a reversing end of the bottom apron runs, legs of said U-shaped frame being connected with one another by means of the bottom apron bridge.

9. A drafting unit according to claim 2, wherein the holder is equipped with a U-shaped frame in which a reversing end of the bottom apron runs, legs of said U-shaped frame being connected with one another by means of the bottom apron bridge.

10. A drafting unit according to claim 3, wherein the holder is equipped with a U-shaped frame in which a reversing end of the bottom apron runs, legs of said U-shaped frame being connected with one another by means of the bottom apron bridge.

11. A drafting unit according to claim 1 wherein the bottom apron bridge is equipped with pins which are directed essentially transversely with respect to its guiding surface and which are inserted into recesses of the holder.

12. A drafting unit according to claim 1, wherein the bottom apron guide is mounted on a holder, and wherein the holder is equipped with a stop which is assigned to a bottom roller which follows the first roller pair.

13. A drafting unit according to claim 12, wherein the stop is constructed as a component which is detachably and exchangeably arranged at the holder.

14. A drafting unit according to claim 1, wherein a common holder is provided for the bottom apron bridge of two adjacent drafting units.

15. A drafting unit according to claim 1, wherein the bottom apron guide is mounted on a holder, and wherein the holder is constructed as a molded plastic part.

16. A drafting unit according to claim 4, wherein the movement of the bottom apron bridge is limited in the direction of the spring force by means of stop device means.

17. A drafting unit according to claim 14, wherein the movement of the bottom apron bridge is limited in the direction of the spring force by means of stop device means.

18. A drafting unit according to claim 15, wherein the movement of the bottom apron bridge is limited in the direction of the spring force by means of stop device means.

* * * * *